United States Patent [19]

Brown

[11] Patent Number: 4,513,993

[45] Date of Patent: Apr. 30, 1985

[54] TEAR OPEN TAMPER RESISTANT GAME TICKET ASSEMBLY

[75] Inventor: Lyman J. Brown, Oak Brook, Ill.

[73] Assignee: Bates Printing Specialties, Inc., Chicago, Ill.

[21] Appl. No.: 477,312

[22] Filed: Mar. 21, 1983

[51] Int. Cl.[3] ..... B42D 15/00; B41L 1/20

[52] U.S. Cl. ..... 283/103; 283/1 B; 282/25

[58] Field of Search ..... 282/25; 283/1 R, 1 B, 283/103; 281/2, 5

[56] References Cited

U.S. PATENT DOCUMENTS

| | | | |
|---|---|---|---|
| Re. 17,948 | 2/1931 | Pedersen | 282/25 |
| 1,467,803 | 9/1923 | Mautner . | |
| 1,591,231 | 7/1926 | Otis | 282/25 |
| 1,677,022 | 7/1928 | Deutschmeister . | |
| 2,706,865 | 4/1955 | Miller | 283/103 |
| 2,813,728 | 11/1957 | Harris | 281/18 |
| 3,104,800 | 9/1963 | Johnson et al. | 229/70 |
| 3,114,565 | 12/1963 | Sornberger | 281/5 |
| 3,426,961 | 2/1969 | Allison | 229/70 |
| 3,672,703 | 6/1972 | Jay | 282/25 |
| 3,736,006 | 5/1973 | Polsky | 283/6 |
| 3,858,792 | 1/1975 | Volkert | 282/25 |
| 3,930,673 | 1/1976 | Sanden | 283/6 |
| 3,945,870 | 3/1976 | Johnsen | 156/201 |
| 4,011,985 | 3/1977 | Simson | 229/68 |
| 4,074,911 | 2/1978 | Stipek, Jr. | 283/6 |
| 4,103,820 | 8/1978 | Mathison et al. | 229/37 |
| 4,108,350 | 8/1978 | Forbes, Jr. | 229/37 |

FOREIGN PATENT DOCUMENTS

| | | | |
|---|---|---|---|
| 2835217 | 2/1980 | Fed. Rep. of Germany | 281/5 |
| 2427195 | 12/1979 | France | 283/1 B |

*Primary Examiner*—Paul A. Bell
*Assistant Examiner*—Paul M. Heyrana, Sr.
*Attorney, Agent, or Firm*—Kinzer, Plyer, Dorn & McEacrhan

[57] ABSTRACT

A tear open tamper resistant game ticket assembly including a rear panel, a front panel, an intermediate panel and a ticket panel. The panels are cut from a single sheet of paper and attached to one another by fold lines so that the panels can be folded over one another into a multi-layered assembly with the ticket panel located between the front panel and the intermediate panel located between the front panel and the rear panel. The intermediate and ticket panels are narrower than the front and rear panels. The rear panel is adhered to the intermediate panel and to portions of the front panel on opposite sides of the intermediate panel when the panels are folded into their multi-layered assembly. Perforated lines are formed in the front and rear panels near the side edges thereof with the perforated lines located approximately in alignment with the side edges of the intermediate panel. A tear tab is formed by slit lines in the front panel and extends between the perforated panels on the side edges thereof. The ticket panel is narrower than the intermediate panel. The face of the ticket panel facing the front panel is covered with concealment printing. The fold line connecting the ticket panel to the intermediate panel is perforated to permit easy removal of the ticket panel from the ticket assembly.

3 Claims, 4 Drawing Figures

TEAR OPEN TAMPER RESISTANT GAME TICKET ASSEMBLY

BACKGROUND AND SUMMARY OF THE INVENTION

This invention is directed to a tamper resistant tear open envelope type ticket assembly.

An object of this invention is such a ticket assembly that is relatively simple to manufacture.

Another object of this invention is an envelope type ticket assembly which requires only a single gluing operation.

Another object of this invention is an envelope type ticket assembly in which the ticket panel is located within a sealed enclosure but is held to the assembly only along one end thereof for ease of removal after the ticket assembly is torn open and unfolded.

Another object of this invention is a tamper resistant tear open ticket assembly in which the sealed ticket assembly enclosing the ticket panel is opened by removing tear strips on opposite sides of the assembly and then removing a tear tab in the front panel of the assembly.

Other objects may be found in the following specification, claims and drawings.

BRIEF DESCRIPTION OF THE DRAWINGS

The invention is illustrated more or less diagrammatically in the following drawings wherein.

DESCRIPTION OF THE PREFERRED EMBODIMENT

Figure 1:
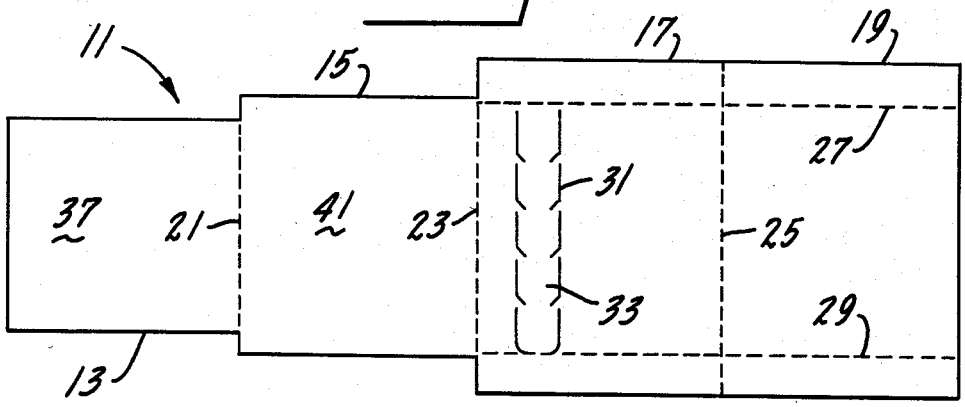
FIG. 1 is a plan view of the paper blank for the tamper resistant tear open envelope ticket assembly of this invention.
Figure 2:
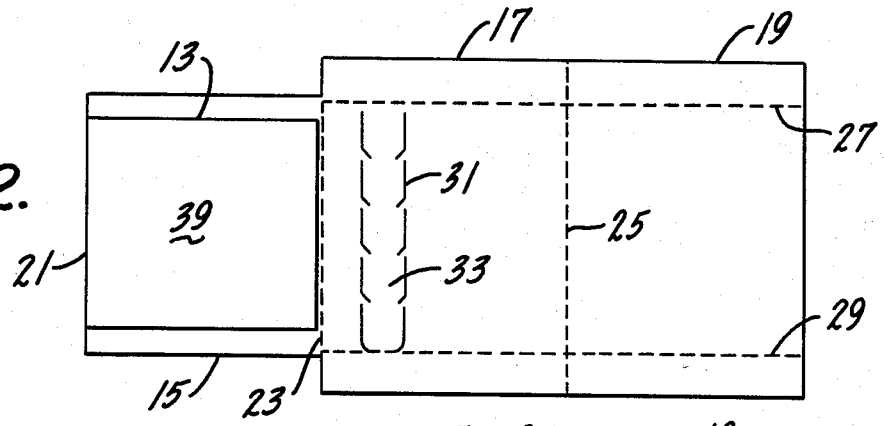
FIG. 2 is a plan view similar to FIG. 1 but showing the ticket panel folded over the intermediate panel.

FIG. 1 of the drawings shows a strip of paper 11 which has been printed with suitable instructions and indicia and die cut into the configuration shown. The strip 11 has a ticket panel 13, an intermediate panel 15, a front panel 17 and a rear panel 19. The panels are connected by fold lines which may be formed by lines of weakness such as those created by perforations or slits. The ticket panel 13 is attached to the intermediate panel 15 by a fold line 21. The intermediate panel 15 is connected to the front panel 17 by a fold line 23 while the front panel 17 is connected to the rear panel 19 by a fold line 25.

Figure 3:
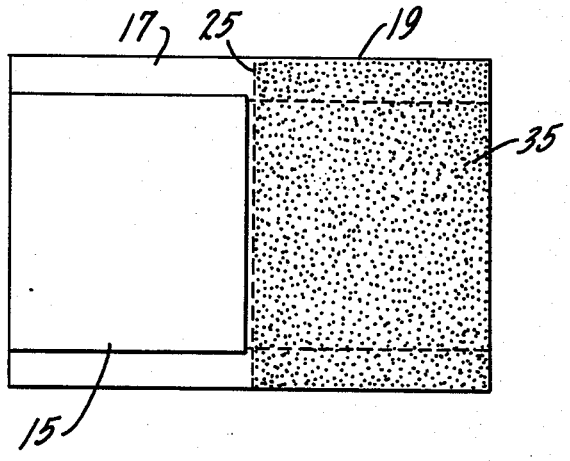
FIG. 3 is a top plan view similar to FIG. 1 showing the ticket and intermediate panels folded over the front panel of the assembly.
Figure 4:
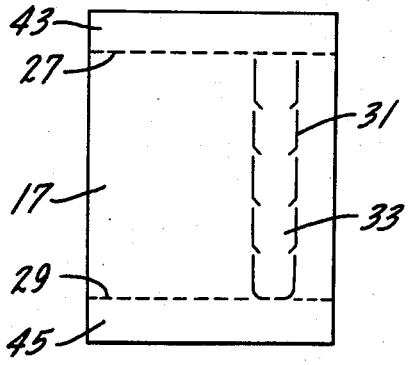
FIG. 4 is a plan view of the ticket in its completely assembled condition.

Lines of perforations 27 and 29 are formed in the front and rear panels 17 and 19 along the sides thereof. These lines of perforations align approximately with the side edges of the intermediate panel 15. Extending between the perforated lines 27 and 29 in the front panel are a pair of slit lines 31 which form a tear tab 33 in the front panel. The ticket panel 13 is narrower than the intermediate panel 15 and slightly shorter in length than the panel 15. The intermediate panel 15 is narrower than the front and rear panels 17 and 19 and not quite as long as the front panel 17. This construction permits the ticket panel 13 to be folded over the intermediate panel 15 which in turn is folded against the front panel 17 as shown in FIG. 3. Then these three panels are folded over the rear panel 19 as shown in FIG. 4.

Before the final folding step, an adhesive 35 is applied to the surface of rear panel 19 to adhere the folded panels into a ticket assembly. This is the only application of adhesive needed to form the ticket assembly. The adhesive 35 will adhere the rear panel 19 to the outer edges of the front panel 17 and to the intermediate panel 15 but not to the ticket panel 13 which is completely covered by the intermediate panel 15. Also, the adhesive will not contact the tear tab 33 in the front panel.

Indicia which will indicate whether the ticket is a winner or a loser or other data such as advertising material can be applied to the face 37 of panel 13. Additional printed material in the form of concealment printing such as a reoccurring pattern of letters or a design may be printed on the opposite face 39 of the ticket panel. Instructional indicia may be printed on the face 41 of the intermediate panel 15 against which the ticket panel 13 is folded.

The assembled ticket is open by the recipient by tearing along the tear lines 27 and 29 to remove the outer portions 43 and 45 of the ticket assembly. The recipient will then remove the tear tab 33 which provides access to the coupon ticket 13 allows the ticket assembly to be unfolded. The face 39 of the coupon panel 13 facing the tear tab has concealment printing 39 thereon so that even tampering with the tear tab cannot indicate to a person whether the ticket is valuable or not valuable, i.e. a winner or loser. The ticket coupon can easily be removed from the ticket assembly after the assembly is unfolded since it is fastened only along its tear line 21 to the intermediate panel and is not held by the adhesive 35.

I claim:

1. A tear open tamper resistant game ticket assembly including:

a rear panel, a front panel, an intermediate panel and a ticket panel, the panels being cut from a single piece of paper and attached to one another by fold lines so that the panels can be folded over one another into a multi-layered assembly with the ticket panel located between the front panel and the intermediate panel and the intermediate panel located between the front panel and the rear panel, the intermediate and ticket panels being narrower than the front and rear panels, the rear panel being adhered to the intermediate panel and to portions of the front panel on opposite sides of the intermediate panel when the panels are folded into their multi-layered assembly, perforated lines formed in the front and rear panels near the side edges thereof with the perforated lines located approximately in alignment with the side edges of the intermediate panel, and a tear tab formed by slit lines in the front panel and extending between the perforated lines on the opposite sides thereof.

2. The game ticket assembly of claim 1 in which the ticket panel is narrower than the intermediate panel.

3. The game ticket assembly of claim 1 in which the fold line connecting the ticket panel to the intermediate panel is perforated to permit easy removal of the ticket panel from the ticket assembly.

* * * * *